US007832148B2

(12) United States Patent
Stoffels

(10) Patent No.: US 7,832,148 B2
(45) Date of Patent: Nov. 16, 2010

(54) LATCH ASSEMBLY FOR SAFETY RAIL SYSTEM

(75) Inventor: Richard B. Stoffels, Eden Prairie, MN (US)

(73) Assignee: Garlock Equipment Company, Minneapolis, MN (US)

( * ) Notice: Subject to any disclaimer, the term of this patent is extended or adjusted under 35 U.S.C. 154(b) by 0 days.

(21) Appl. No.: 12/824,414

(22) Filed: Jun. 28, 2010

(65) Prior Publication Data

US 2010/0264674 A1 Oct. 21, 2010

Related U.S. Application Data

(62) Division of application No. 11/671,096, filed on Feb. 5, 2007, now Pat. No. 7,743,556.

(60) Provisional application No. 60/812,728, filed on Jun. 12, 2006.

(51) Int. Cl.
*E05B 65/06* (2006.01)

(52) U.S. Cl. ..... 49/394; 292/194; 292/196; 292/200; 292/210; 292/304

(58) Field of Classification Search ..... 49/394, 49/395, 396, 465, 381, 50; 292/194, 195, 292/202, 210, 304, 196, 200, DIG. 29
See application file for complete search history.

(56) References Cited

U.S. PATENT DOCUMENTS

| | | | | |
|---|---|---|---|---|
| 2,517,386 A | | 8/1950 | Cooper | 256/25 |
| 2,895,717 A | | 7/1959 | Falco | 256/25 |
| 3,020,023 A | | 2/1962 | MacIntyre et al. | 256/24 |
| 3,325,204 A | * | 6/1967 | Case | 292/202 |
| 3,469,822 A | | 9/1969 | O'Brien | 256/25 |
| 3,740,022 A | | 6/1973 | DiGiovanni | 256/24 |
| 3,776,521 A | | 12/1973 | Weinert | 256/24 |
| 3,931,700 A | | 1/1976 | Scanni et al. | 52/590 |
| 4,015,826 A | | 4/1977 | Lauzier | 256/59 |
| 4,145,031 A | | 3/1979 | Baker, II | 256/65 |
| 4,645,183 A | | 2/1987 | Rattray et al. | 256/25 |
| 4,787,475 A | | 11/1988 | Arteau et al. | 182/82 |
| 4,787,603 A | | 11/1988 | Norton | 256/25 |
| 4,869,343 A | | 9/1989 | Anderson | 182/113 |
| 5,103,658 A | | 4/1992 | McQuade | 70/77 |
| 5,145,153 A | | 9/1992 | Glynn | 256/59 |
| 5,161,784 A | | 11/1992 | Sader | 256/24 |
| 5,188,342 A | | 2/1993 | Ouellette et al. | 256/65 |

(Continued)

*Primary Examiner*—Jerry Redman
(74) *Attorney, Agent, or Firm*—Alan Kamrath; Kamrath & Associates PA

(57) ABSTRACT

A gate (106) includes a panel (112) movable relative to a fixed member (110) between an open position and a closed position. A linkage (140) is pivotally mounted to the panel (112) about a latch pivot axis. A catch (130) is pivotally mounted to the linkage (140) about a catch pivot axis spaced from and parallel to the latch pivot axis. The catch (130) is movable between a latched position engaged with the fixed member (110) and an unlatched position disengaged from the fixed member (110). The catch (130) defines a groove for slideable receipt on the fixed member (110). When the catch (130) is in the latched position and the panel (112) is in the closed position, the catch (130) abuts against opposite sides of the fixed member (110) along an extended length such that forces are applied on each side at spaced locations to resist twisting forces.

8 Claims, 3 Drawing Sheets

U.S. PATENT DOCUMENTS

| | | | | |
|---|---|---|---|---|
| 5,362,030 | A | 11/1994 | Iler, Jr. et al. | 256/65 |
| 5,456,451 | A | 10/1995 | Eyler, Jr. | 256/67 |
| 5,518,337 | A | 5/1996 | Modlin | 404/10 |
| 5,547,169 | A | 8/1996 | Russell | 256/67 |
| 5,566,927 | A | 10/1996 | Venegas, Jr. | 256/59 |
| 5,593,141 | A | 1/1997 | Cain et al. | 256/26 |
| 5,609,327 | A | 3/1997 | Amidon | 256/24 |
| 5,683,074 | A | 11/1997 | Purvis et al. | 256/67 |
| 5,779,227 | A | 7/1998 | Elkins et al. | 256/31 |
| 5,816,554 | A | 10/1998 | McCracken | 248/346.01 |
| 5,842,685 | A | 12/1998 | Purvis et al. | 256/67 |
| 6,038,829 | A | 3/2000 | Franks | 52/645 |
| 6,039,308 | A | 3/2000 | Venegas, Jr. | 256/65 |
| 6,053,281 | A | 4/2000 | Murray | 182/113 |
| 6,220,577 | B1 | 4/2001 | Ostrow | 256/67 |
| 6,229,497 | B1 | 5/2001 | McCracken | 343/878 |
| 6,283,457 | B1 | 9/2001 | Venegas, Jr. | 256/65 |
| 6,554,257 | B1 | 4/2003 | Kenton | 256/24 |
| 6,565,069 | B2 | 5/2003 | Morris | 256/73 |
| 6,578,827 | B2 | 6/2003 | McCracken | 256/59 |
| 6,585,080 | B2 | 7/2003 | Murray | 182/45 |
| 6,845,970 | B1 | 1/2005 | Kenton | 256/73 |
| 6,902,153 | B1 | 6/2005 | Kenton | 256/65.1 |
| 2001/0007342 | A1 | 7/2001 | McCracken | 248/68.1 |
| 2001/0020559 | A1 | 9/2001 | McCracken | 182/222 |
| 2002/0081152 | A1 | 6/2002 | King | 404/6 |
| 2002/0094235 | A1 | 7/2002 | King | 404/6 |
| 2003/0042072 | A1 | 3/2003 | Murray | 182/45 |
| 2003/0167724 | A1 | 9/2003 | Mccracken | 52/690 |
| 2004/0103589 | A1 | 6/2004 | Purvis et al. | 52/24 |

* cited by examiner

LATCH ASSEMBLY FOR SAFETY RAIL SYSTEM

CROSS REFERENCE

The present application is a division of U.S. application Ser. No. 11/671,096 filed on Feb. 5, 2007, now U.S. Pat. No. 7,743,556, which claims the benefit of U.S. Provisional Appln. No. 60/812,728 filed on Jun. 12, 2006.

BACKGROUND

The present invention relates to safety rail systems, and in preferred aspects to latch assemblies for gates of safety rail systems which include fewer components and are easier to use and manufacture.

Barricades are often required on a temporary (or removable) basis. Examples include but are not limited to at construction sites such as to keep workers from falling off an edge of a roof or a level, falling down uncompleted stairwells, and the like, to keep the general public out of the construction site, and the like. Other uses include limiting access such as at festivals, sporting events, and the like. Safety rail systems have become a favored manner of providing such barricades in many applications.

Such safety rail systems utilize railings formed of tubular stock and having horizontal rails extending between vertical posts. The advantages of such railings are that they can be mass produced in multiple sizes very economically. The railings of the desired size can then be selected according to the particular application. In the application, the lower ends of the posts of the railings are slid into tubular sockets or receptors. However, it can be appreciated that passage through the barricades is required at least in some instances. Towards that end, gates are provided which can be opened and closed as desired. Thus, latch assemblies are needed which allow the gates to be opened when in an unlatched position but which prevent accidental or unintentional opening of the gates when in a latched position.

Thus, a need exists for a latch assembly for a safety rail system which includes fewer components and is easier to use and manufacture.

SUMMARY

The present invention solves this need and other problems in the field of safety rail systems by providing, in a first aspect, a novel latch assembly for a gate for a safety rail system.

In another aspect of the present invention, a novel latch assembly for a safety rail system includes only a single linkage pivotably mounted to a vertical latch post of the safety rail system.

In still a further aspect of the present invention, a novel latch assembly for a safety rail system engages the vertical latch post along an extended length.

In still another aspect of the present invention, a novel latch assembly for a safety rail system includes relatively fewer moveable components that can be easily fabricated and assembled.

A gate according to the preferred teachings of the present invention includes a fixed member and a panel movable relative to the fixed member between an open position allowing access between the fixed member and the panel to allow passage and a closed position preventing access between the fixed member and the panel to prevent passage. A linkage is pivotally mounted to one of the panel and the fixed member about a latch pivot axis. A catch is pivotally mounted to the linkage about a catch pivot axis spaced from and parallel to the latch pivot axis. The catch is movable between a latched position engaged with the other of the panel in the closed position and the fixed member to thereby prevent movement of the panel relative to the fixed member from the closed position and an unlatched position disengaged from the other of the panel and the fixed member to thereby allow movement of the panel relative to the fixed member. The catch defines a groove for slideable receipt on the other of the panel and the fixed member, and the catch abuts against opposite sides of the other of the panel in the closed position and the fixed member when the catch is in the latched position.

In a preferred form, the panel and the fixed member have a spacing therebetween when the panel is in the closed position, and the catch is located in the spacing between the panel and the fixed member when the catch is in the unlatched position. In the most preferred form, the catch includes two latch plates parallel to and spaced from each other to define the groove for slideable receipt on the other of the panel and the fixed member. Each latch plate includes a width extending in a direction parallel to the spacing between the panel and the fixed member and an extended length extending in a direction perpendicular to the spacing between the panel and the fixed member and multiple times and in the most preferred form four times greater than the width. The latch plates respectively abut along a line against the opposite sides of the other of the panel in the closed position and the fixed member when the catch is in the latched position for increased resistance against twisting of the panel.

In the most preferred form, the catch further includes an interconnecting abutment plate connected between the latch plates and forming a substantially U-shaped structure defining the groove for receiving the other of the panel and the fixed member. Each latch plate further includes upper and lower ends extending along the width and defining the length therebetween. In the preferred form, two upper flanges respectively extend outward away from each other from the upper ends of the latch plates along the width and perpendicular to the length. Similarly, two lower flanges respectively extend outward away from each other from the lower ends of the latch plates along the width and perpendicular to the length. The catch pivot axis extends at about one fourth of the length from the upper end of each of latch plate.

In the most preferred form, the panel includes a post to which the linkage is pivotally connected. The linkage includes two arms spaced from and parallel to each other. The post extends perpendicularly to the latch pivot axis. An end of each arm is pivotally connected to the catch by a pivot pin defining the catch pivot axis. A first spindle defining the latch pivot axis extends through the arms and the post. A second spindle extends through the arms and spaced from and parallel to the first spindle and the catch for holding the arms in a parallel relationship to prevent the catch from being pinched by the arms.

In a preferred form, an abutment is fixed to the post, and the latch pivot axis is located intermediate two ends of the arms. The other end of each arm abuts against the abutment when the catch is in the latched position. The other end of each arm moves away from the abutment when moving the catch from the latched position to the unlatched position. The abutment further includes a lip extending downward from a side thereof. The lip is parallel to and spaced from one of the other ends of the arms that has an aperture aligned with another aperture in the lips. A latch member can be extended through the apertures to prevent pivoting of the linkage from the latched position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
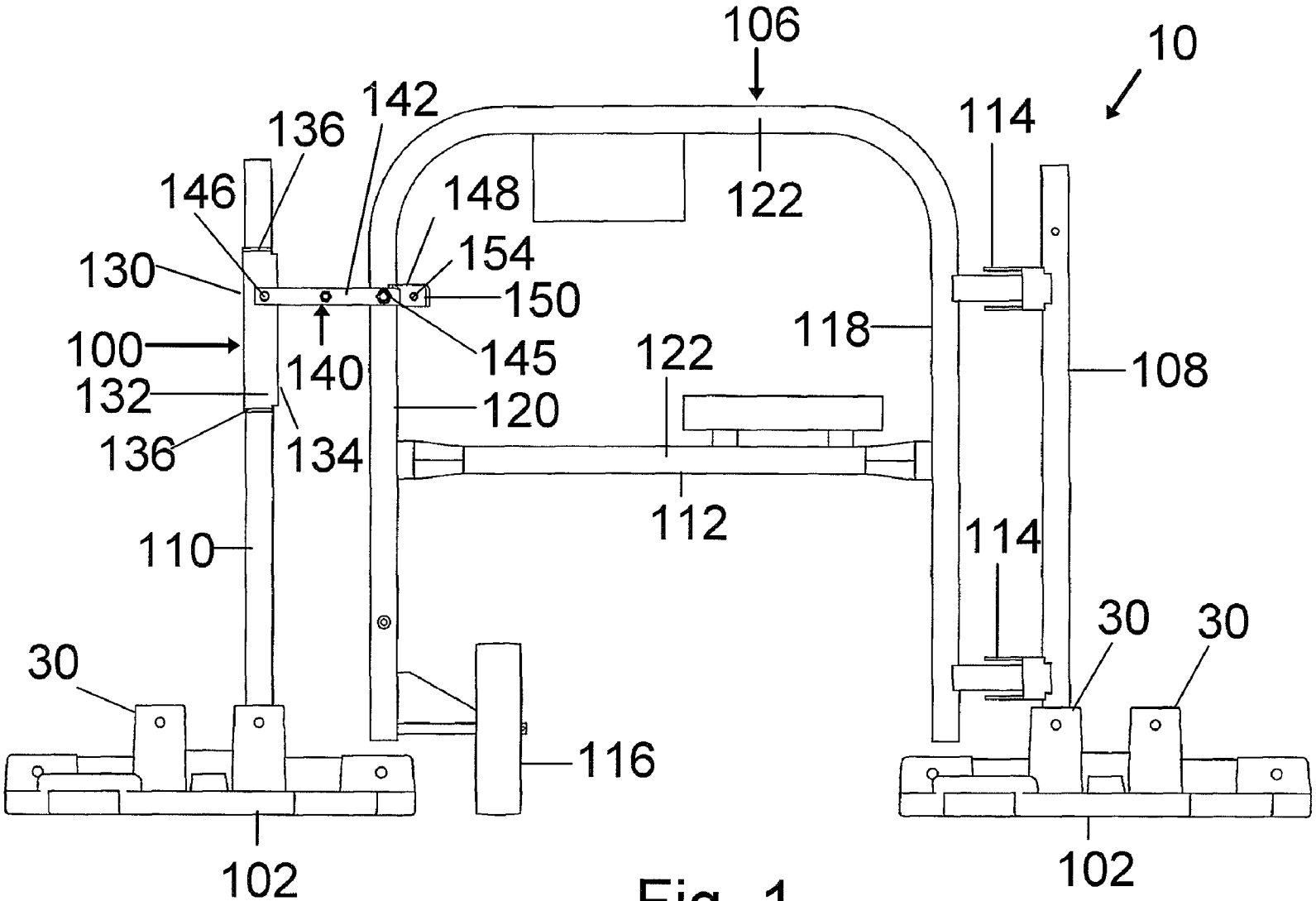
FIG. 1 shows a partial front view of a safety rail system according to the preferred teachings of the present invention.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "upper", "lower", "first", "second", "width", "length", "spacing", "channel", "groove", "end", "side", "horizontal", "vertical", and similar terms are used herein, it should be understood that these terms have reference only to the structure shown in the drawings as it would appear to a person viewing the drawings and are utilized only to facilitate describing the illustrative embodiment.

DESCRIPTION OF THE PREFERRED EMBODIMENTS

A latch assembly for a safety rail system according to the preferred teachings of the present invention is shown in the drawings and generally designated 100. In particular, safety rail system 10 can be of a variety of forms including railings which are secured to a horizontal supporting surface. In the preferred form shown, safety rail system 10 is removably placed and/or relatively movable on the horizontal supporting surface. In most preferred forms, safety rail system 10 includes mounting plates 102 having relatively large masses such as cast or otherwise fabricated bases of the types shown in U.S. Pat. Nos. 3,020,023; 3,776,521; 4,787,603; 5,816,554; or 6,554,257. Thus, in such applications, it is generally desired to utilize safety rail system 10 for temporary purposes. However, in other applications, mounting plates 102 could be permanently secured to or relative to the horizontal supporting surface. Likewise, the railings can be removably mounted to the mounting plates 102 such as by being slideably received in post receptors 30 formed on mounting plate 102 shown or can be permanently secured to the mounting plates 102.

According to the preferred teachings of the present invention, safety rail system 10 includes a gate 106 including two spaced fixed members 108 and 110. In a preferred form, fixed members 108 and 110 are respectively in the form of a pivot post and a latch post shown as being slideably received in receptors 30 of different mounting plates 102. In the preferred form, fixed members 108 and 110 are cylindrical, in the most preferred form tubular, and are shown as having circular cross sections.

Gate 106 further includes a panel 112 moveable relative to fixed member 110 between an open position allowing access between fixed member 110 and panel 112 to allow passage and a closed position preventing access between fixed member 110 and panel 112 to prevent passage. It is noted that panel 112 and fixed member 110 have a spacing therebetween when panel 112 is in the closed position. In the most preferred form shown, panel 112 has a first side pivotably mounted to fixed member 108 such as by a pair of hinges 114 vertically spaced and extending between panel 112 and fixed member 108 for pivotably mounting panel 112 about a pivot axis extending parallel to but spaced from fixed member 108. Hinges 114 can be of any desired form as conventional including but not limited to of a commercially available type.

Gate 106 in the form shown includes a support wheel 116 suitably secured to a second side of panel 112 opposite to hinges 114. The purpose of support wheel 116 is to reduce the torque stress placed upon hinges 114. Thus, support wheel 116, if desired and provided, can be of any desired form as conventional including but not limited to of a commercially available type.

Panel 112 according to the teachings of the present invention can be of a variety of forms and types which functions to prevent access between fixed members 108 and 110 when in a latched condition. In the form shown, panel 112 includes a vertical hinge column or post 118 defining the first side of panel 112 and a vertical latch column or post 120 defining the second side of panel 112. Posts 118 and 120 are held in a spaced parallel relation such as by a plurality of horizontal bars 122 extending therebetween. It should be appreciated that bars 122 can be suitably secured with posts 118 and 120 such as by being integrally formed therewith such as by bending, by welding, or the like. Bars 122 can have a fixed length or can have an adjustable length such as being telescopic. Panel 112 can also include suitable enclosure provisions such as netting, sheeting, or the like extending between posts 118 and 120 and bars 122.

According to the preferred teachings of the present invention, latch assembly 100 includes an elongated catch 130 to slideably receive fixed member 110. Catch 130 is movably mounted to latch post 120 between a latched position and an unlatched position according to the preferred teachings of the present invention. Catch 130 is in the spacing between panel 112 and fixed member 110 when catch 130 is in the unlatched position. In the most preferred form, catch 130 is in the form of a channel having U-shaped cross sections. In particular, catch 130 includes first and second latch plates 132 held in a spaced parallel relation by an interconnecting abutment plate 134, with a groove being defined between plates 132. Each latch plate 132 includes a width extending in a direction parallel to the spacing between panel 112 and fixed member 110. Specifically, in the preferred foam, the widths of plates 132 each are of a size to be received in the spacing between panel 112 and fixed member 110 in the closed position and in the preferred form considerably smaller than the spacing, particularly, in the order of less than 50% of the spacing and in the most preferred form less than 30% of the spacing. However, the width of plates 132 are of a size to present a substantial overlap with panel 112 and in the preferred form shown greater than a diameter of fixed member 110.

Each latch plate 132 further includes an extended length extending in a direction perpendicular to the spacing between panel 112 and fixed member 110 and multiple times greater than the width. Specifically, in the preferred form, the extended length is at least three times greater than the width and, in the most preferred form shown, is in the order of four times the width. Each plate 132 includes upper and lower ends extending along the width and defining the length therebetween. The upper and lower ends of plates 132 each include an outwardly extending flange 136 extending generally perpendicular to plates 132 and 134 along the width and perpendicular to the length. An aperture 138 is formed in plate 134 intermediate plates 132. The groove between plates 132 is generally equal to but slightly greater than the diameter of and for slideable receipt on post 110.

In the form shown, a linkage 140 includes first and second arms 142 held in a spaced parallel relation by spindles 144 extending generally perpendicular therebetween. Arms 142 and spindles 144 are suitably removably secured together such as by bolts 145 extending through arms 142 and spindles 144. Spindles 144 are spaced inwardly from the opposite ends of arms 142. The outer ends of first and second arms 142 are pivotally mounted to first and second latch plates 132, respectively, about a catch pivot axis extending approximately midway between the free edges of plates 132 and abutment plate 134 or of the width of plates 132 and at about one fourth of the length from the outwardly extending flanges 136 of the upper end towards the outwardly extending flanges 136 of the lower end. Arms 142 are pivotably mounted by any suitable manner that does not detrimentally protrude between plates 132 such as by hinge clip pins 146 extending through plates 132 and arms 142.

Arms 142 are further pivotably mounted to latch post 120 of gate 106 about a latch pivot axis spaced from and parallel to the catch pivot axis defined by pivot pins 146. In the most preferred form, spindle 144 opposite to catch 130 is rotatably received (and/or arms 142 are pivotable relative to spindle 144) in a passage formed in latch post 120 and defines the latch pivot axis. In the most preferred form, the ends of arms 142 opposite to catch 130 extend beyond post 120.

In the most preferred form, latch assembly 100 includes provisions to prevent arms 142 from pivoting at an obtuse angle downwardly relative to post 120. In the preferred form, an abutment 148 extending horizontally and generally perpendicular to post 120 against which the top surface of the free ends of aims 142 abut to prevent pivotal movement therebeyond.

In the preferred form shown, abutment 148 includes a downwardly extending U-shaped lip 150. In the most preferred form, apertures 152 are formed in the free ends of arms 142 outwardly of column 120. Corresponding apertures 154 are formed in lip 150. Thus, latch assembly 100 can be locked in a latched position by a latch member such as by a rod extending through all of apertures 152 and 154, by a padlock extending through aperture 152 in one of arms 142 and aperture 154 in one side of lip 150 or the like.

Figure 2:
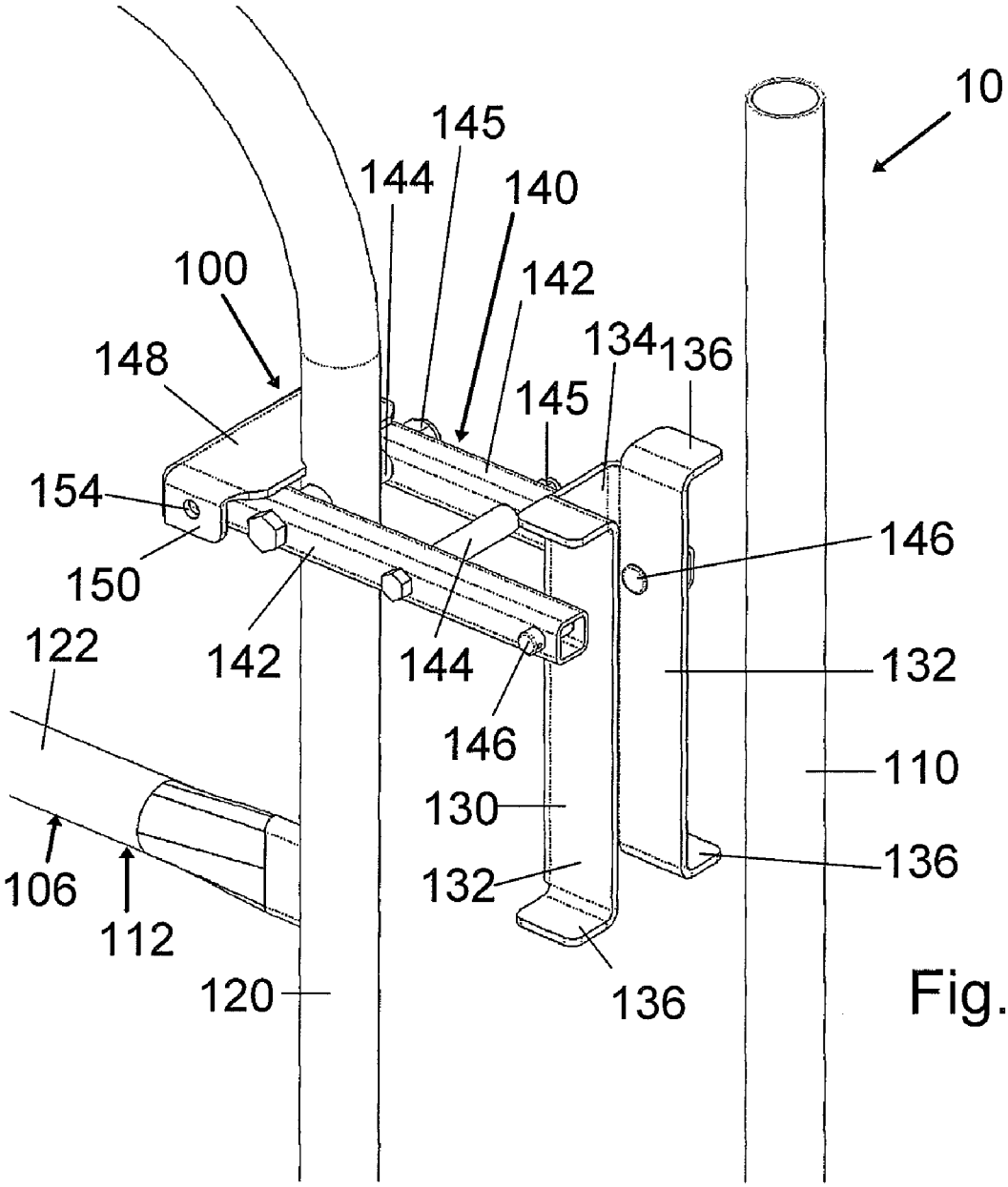
FIG. 2 shows a partial perspective view of the safety rail system of FIG. 1.

Now that the basic construction of latch assembly 100 according to the preferred teachings of the present invention has been set forth, a method of operation can be explained, and some of the advantages obtained thereby highlighted. In particular, for the sake of explanation, it will be assumed that gate 106 is open or in other words extends at an angle to a plane defined by fixed members 108 and 110 and that latch assembly 100 is not being engaged. Due to the mass of catch 130, arms 142 will pivot about the latch pivot axis with the outer ends of arms 142 moving downwardly until the inner ends of arms 142 abut with abutment 148 as shown in FIG. 2 such that arms 142 are generally horizontal and extend generally perpendicular to post 120. Catch 130 will typically pivot relative to arms 142 due to gravitational forces generally vertically and in a spaced parallel relation to post 120. With latch assembly 100 in the position shown in FIG. 2, gate 106 can be pivoted about hinges 114 from a position where flanges 136 of catch 130 abut with fixed member 110 and potentially up to an angle of 180° relative thereto.

Figure 3:
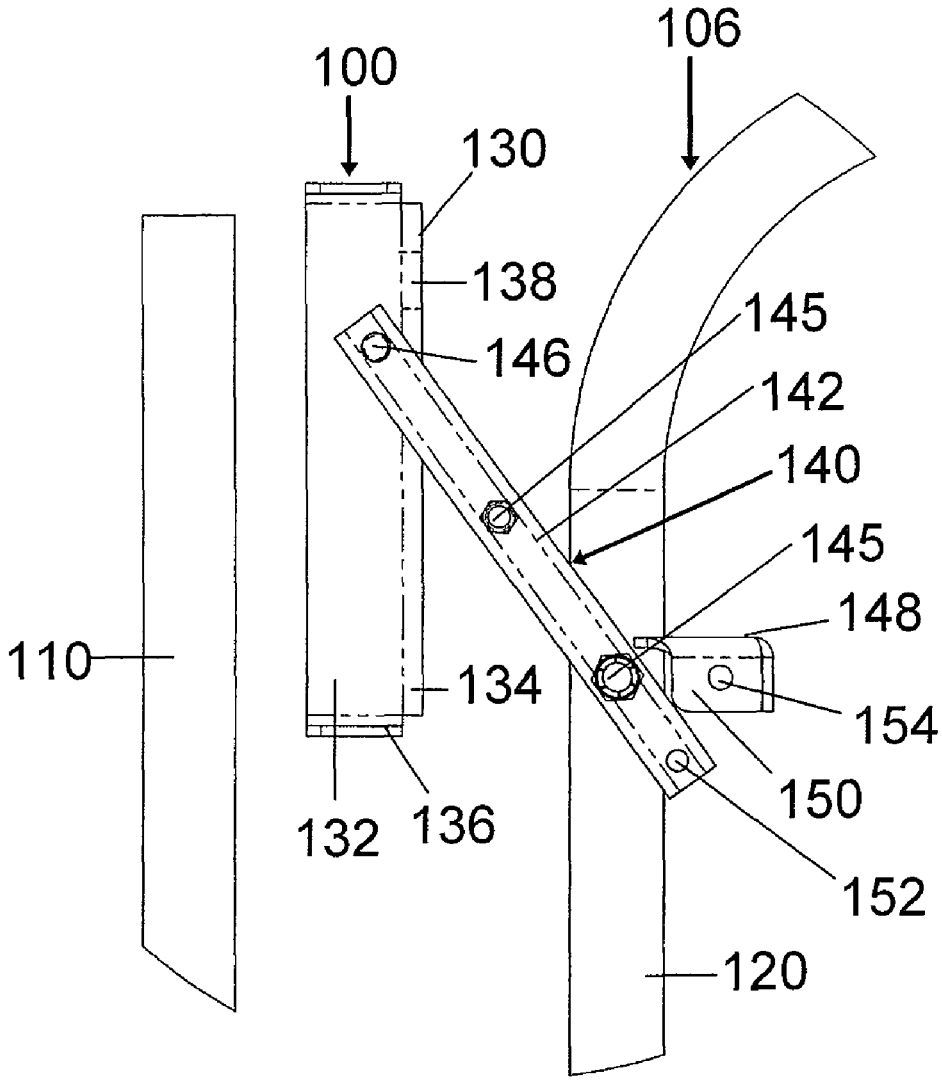
FIG. 3 shows a partial front view of the safety rail system of FIG. 1.

When it is desired to latch gate 106, a user pivots linkage 140 relative to latch post 120 from the position shown in FIG. 2 to the unlatched position shown in FIG. 3. Latch assembly 100 can be pivoted by placing an upward force upon any one or more of flanges 136 which act as a handle or knob, upon catch 130 other than at flanges 136 and/or upon linkage 140. In the unlatched position, catch 130 is generally parallel to post 120 and post 110 and at a distance from post 120 less than the spacing of post 110 from panel 112 in the closed position. With latch assembly 100 in the unlatched position, gate 106 can be pivoted upon hinges 114 into the plane including fixed members 108 and 110.

With gate 106 in the plane of fixed members 108 and 110, the upward force upon latch assembly 100 can be released such that linkage 140 pivots relative to latch post 120 from the unlatched position shown in FIG. 3 to the latched position shown in FIG. 1. With catch 130 aligned with fixed member 110, latch plates 132 will slide on opposite sides of fixed member 110 such that fixed member 110 is received in catch 130. It should be appreciated that as latch assembly 100 pivots from the unlatched position, the distance of abutment plate 134 and catch 130 from latch post 120 increases. Depending upon the spacing of fixed member 110 from post 120, abutment plate 134 could engage fixed member 110 and prevent further pivoting of linkage 140 before arms 142 engage and are stopped by abutment 148 before the position shown in FIG. 2 or could pivot until where abutment plate 134 either does not engage or slightly engages with fixed member 110 such that arms 142 engage with and are stopped by abutment 148 in the relative position with gate 106 as shown in FIG. 2.

In the latched position shown in FIG. 1, latch assembly 100 according to the preferred teachings of the present invention holds gate 106 from pivotal movement about hinges 114 due to the abutment of plates 132 of catch 130 on opposite sides of fixed member 110 and due to the abutment of the opposite ends of arms 142 with the sides of lip 150 and due to the pivotal interconnection of linkage 140 with latch post 120. Further, it should be appreciated that since one end of linkage 140 is fixed (but allowing pivotal movement) and the engagement of catch 130 along an extended length of fixed member 110, stability of gate 106 to remain in the plane defined by fixed members 108 and 110 is promoted since gate 106 is engaged at two points at hinges 114 relative to fixed member 108 and along a line defining multiple spaced points by catch 130 at fixed member 110 as opposed to a single point provided by a conventional single latch.

If desired, latch assembly 100 according to the teachings of the present invention can be prevented from being moved from the position shown in FIGS. 1 and 2. Specifically, a latch member such as a rod, padlock, bolt, pin or the like can be extended through apertures 152 and 154 to prevent pivoting of linkage 140 relative to latch column 120.

It can be appreciated that the linkage 140 can be pivotally mounted to fixed member 110 instead of post 120 of panel 112. In this case, the catch 130 is releasably engaged with the post 120 of panel 112, and abutment 148 is provided on fixed member 110. Detailed arrangement of the corresponding elements and operation of the linkage 140 and the catch 130 according to the teachings of the present invention would be within the skill of the art.

Latch assembly 100 according to the teachings of the present invention includes relatively fewer moveable components that can be easily fabricated and assembled at low cost. Furthermore, operation of latch assembly 100 according to the teachings of the present invention is easy and reliable.

Furthermore, latch assembly 100 according to the teachings of the present invention can be used with commercially available safety rail systems with or without minor modification of these commercially available safety rail systems.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly comprising, in combination:

a linkage adapted to be pivotally mounted to one of a fixed member and a panel that is movable relative to the fixed member between an open position allowing access between the fixed member and the panel to allow passage and a closed position preventing access between the fixed member and the panel to prevent passage, with the linkage being pivotable relative to the one of the fixed member and the panel about a latch pivot axis; and a catch pivotally mounted to the linkage about a catch pivot axis spaced from and parallel to the latch pivot axis, with the catch being movable between a latched position engaged with the other of the fixed member and the panel in the closed position to thereby prevent movement of the panel relative to the fixed member from the closed position and an unlatched position disengaged from the other of the fixed member and the panel to thereby allow movement of the panel relative to the fixed member, with the catch defining a groove for slideable receipt on the other of the panel and the fixed member, and with the catch respectively abutting against opposite sides of the other of the fixed member and the panel in the closed position when the catch is in the latched position.

2. The latch assembly as claimed in claim 1, with the panel and the fixed member having a spacing therebetween when the panel is in the closed position, with the catch being located in the spacing between the panel and the fixed member when the catch is in the unlatched position, with the catch including first and second latch plates parallel to and spaced from each other to define the groove for slideable receipt on the other of the panel and the fixed member, with each of the first and second latch plates including a width extending in a direction parallel to the spacing between the panel and the fixed member, with each of the first and second latch plates including a length extending in a direction perpendicular to the spacing between the panel and the fixed member and greater than the width, and with the first and second latch plates respectively abutting against the opposite sides of the other of the panel in the closed position and the fixed member when the catch is in the latched position.

3. The latch assembly as claimed in claim 2, with the catch further including an interconnecting abutment plate connected between the first and second latch plates, forming a substantially U-shaped structure defining the groove for receiving the other of the panel and the fixed member.

4. The latch assembly as claimed in claim 3, with each of the first and second latch plates including upper and lower ends extending along the width and defining the length therebetween, with two upper flanges respectively extending outward away from each other from the upper ends of the first and second latch plates along the width and perpendicular to the length, and with two lower flanges respectively extending outward away from each other from the lower ends of the first and second latch plates along the width and perpendicular to the length.

5. The latch assembly as claimed in claim 2, with each of the first and second latch plates including upper and lower ends extending along the width and defining the length therebetween, and with the catch pivot axis extending at about one fourth of the length from the upper end of each of the first and second latch plates.

6. The latch assembly as claimed in claim 1, with one of the panel and the fixed member including a post to which the linkage is pivotally connected, with the linkage including first and second arms spaced from and parallel to each other, with the post extending perpendicularly to the latch pivot axis, with each of the first and second arms including a first end pivotally connected to the catch by a pivot pin defining the catch pivot axis and a second end, with the linkage further including a first spindle extending through the first arm, the post, and the second arm, with the first spindle defining the latch pivot axis, and with the linkage further including a second spindle extending through the first and second arms and spaced from and parallel to the first spindle and the catch for holding the first and second arms in a parallel relationship to prevent the catch from being pinched by the first and second arms.

7. The latch assembly as claimed in claim 6, with the gate further including an abutment fixed to the post, with the latch pivot axis located intermediate the first and second ends of the first and second arms, with the second ends of the first and second arms abutting against the abutment when the catch is in the latched position, with the second ends of the first and second arms moving away from the abutment when moving the catch from the latched position to the unlatched position, with the abutment further including a lip extending downward from a side thereof, with the lip being parallel to and spaced from one of the second ends of the first and second arms, with the lip including a first aperture, with the one of the second ends of the first and second arms having a second aperture aligned with the first aperture when the catch is in the latched position, and with the first and second apertures adapted to be extended through by a latch member to prevent pivoting of the linkage from the latched position.

8. The latch assembly as claimed in claim 1, with the gate further including an abutment fixed to the one of the panel and the fixed member, and with the linkage abutting against and being stopped by the abutment when the catch is in the latched position, with the catch moving away from the abutment when moving the catch from the latched position to the unlatched position, with the abutment including a first aperture, with the linkage having a second aperture aligned with the first aperture when the catch is in the latched position, with the first and second apertures adapted to be extended through by a latch member to prevent pivoting of the linkage from the latched position.

* * * * *

UNITED STATES PATENT AND TRADEMARK OFFICE

CERTIFICATE OF CORRECTION

PATENT NO. : 7,832,148 B2
APPLICATION NO. : 12/824414
DATED : November 16, 2010
INVENTOR(S) : Richard B. Stoffels It is certified that error appears in the above-identified patent and that said Letters Patent is hereby corrected as shown below:

Title page 2, item (56), right column, line 14, cancel
"2003/0167724 A1 9/2003 Mccracken.....52/690"
and substitute therefore
--2003/0167724 A1 9/2003 McCracken.....52/690--.

Signed and Sealed this
Fifteenth Day of February, 2011

David J. Kappos

David J. Kappos
*Director of the United States Patent and Trademark Office*